US005472163A

United States Patent [19]

Callas

[11] Patent Number: 5,472,163

[45] Date of Patent: Dec. 5, 1995

[54] SIGN HOLDER

[75] Inventor: Mike T. Callas, Minneapolis, Minn.

[73] Assignee: Callas Enterprises, Inc., Minneapolis, Minn.

[21] Appl. No.: 249,310

[22] Filed: May 25, 1994

Related U.S. Application Data

[63] Continuation-in-part of Ser. No. 21,221, Apr. 11, 1994, Pat. No. D. 357,505.

[51] Int. Cl.[6] ..... A47E 1/17

[52] U.S. Cl. ..... 248/206.5; 40/600; 40/606

[58] Field of Search ..... 248/206.5, 683; 40/606, 607, 600, 594; 211/DIG. 11, 86

[56] References Cited

U.S. PATENT DOCUMENTS

D. 229,452 11/1973 Bentley .
3,148,856 9/1964 Orlando .
3,178,138 4/1965 Hessdoerfer et al. .
3,532,310 10/1970 Finrock .
4,677,780 7/1981 Shuman ..... 40/600
4,776,116 10/1988 Shuman ..... 40/606 X
4,776,549 10/1988 Anastos ..... 248/206.5

OTHER PUBLICATIONS

Eastern Display Products Publication (Hugger Hanger).

*Primary Examiner*—Ramon O. Ramirez
*Attorney, Agent, or Firm*—Burd Bartz & Gutenkauf

[57] ABSTRACT

A magnetic holder for a merchandising display sign is mounted on the corner of an upright metal support. A permanent magnet wedged between a pair of metal plates is enclosed within an elongated right angle shaped body shell thereby providing horizontal stability and a strong-holding force to firmly retain holder on the support. An upright cylindrical adaptor attached to the top of the body shell is used to accommodate the shaft of a sign.

26 Claims, 3 Drawing Sheets

SIGN HOLDER

This is a C-I-P of Ser. No. 021,221, filed Apr. 11, 1994, now Des. 357,505.

FIELD OF THE INVENTION

The invention and more particularly to magnetic supports for devices such as store signage.

BACKGROUND OF THE INVENTION

Damage by moisture resulting in premature and unnecessary replacement costs of signs and supports therefore is a reoccurring problem in store merchandising systems. Also, the display signs are located at a level where customers and stock persons can bump and damage the display sign while moving about the store. Previous elevated display sign mounts have been found to be relatively unstable and lacking a strong-holding force to retain the holder on a support surface.

SUMMARY OF THE INVENTION

The invention is directed to an improved sign holder having an elongated body with an upright cylindrical adapter. The adapter has a centrally located top opening accommodating a pole to carry display signs. The shape of the hole in the adapter can be varied to have a circular shape, circular threaded shape, rectangular shape, star-shaped and the like, for different applications. The holder includes a magnet that is wedged between metal plates creating magnetic poles which increase the magnetic holding strength of the holder. The magnetic poles adhere to a vertical surface of a metal support to prevent inadvertent dislocation of the sign holder from the support. The top of the holder body is supported on the top of the support. The body of the holder has a shape similar to an angle bracket to fit corners of an upright support, such as a metal display case. The holder is manufactured of a durable metal body having a relatively sturdy construction. The holder elevates the display sign mount obviating the need for a floor support. The elevated mount economizes space. Also, the display signs are easier to be seen by customers and stock persons. Shorter poles can be used requiring less material to make the poles. The display signs are easily changed by removing the pole from the socket and changing the sign. These and other features and advantages of the sign holder are set out in the following disclosure and drawing.

DESCRIPTION OF THE PREFERRED EMBODIMENT

Figure 1:
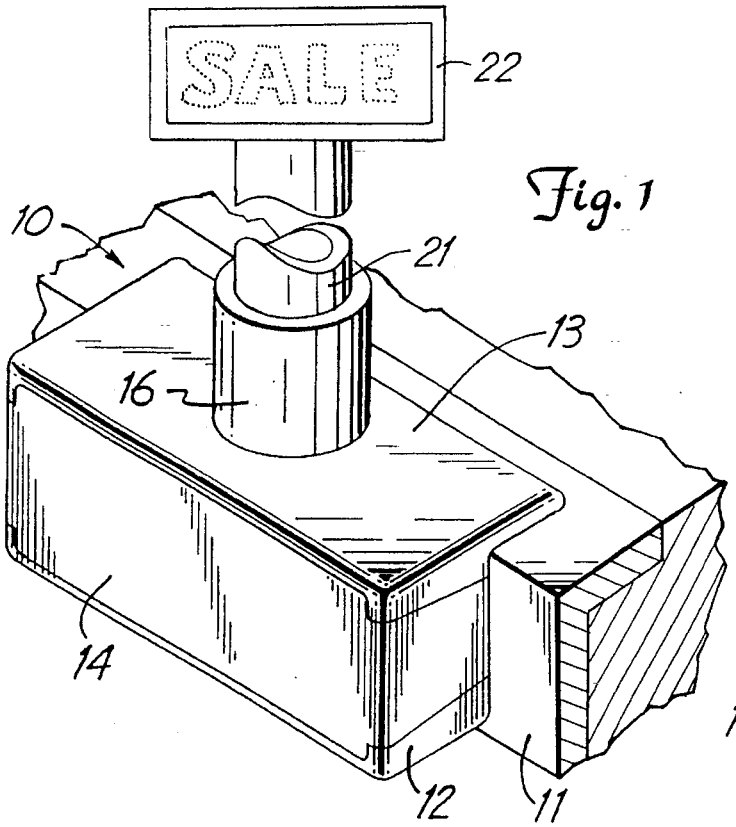
FIG. 1 is a perspective view of the sign holder of the invention mounted on a support accommodating a sign.

Referring to FIGS. 1 to 7 there is shown a sign holder of the invention indicated generally at 10 for accommodating a sign 22 and magnetically attachable to a metal support surface 11. Holder 10 is used in point of purchase advertising display systems.

Holder 10 has a first inverted L-shaped body section 12 coupled to a second U-shaped body section 14 forming a right angled shaped shell or body member. First body section 12 has an upper horizontal, generally rectangular top member 13 and a depending vertical, generally rectangular side member 27 joined to a lower horizontal, generally rectangular bottom member 28. A relatively large permanent magnet 26 located between a pair of metal plates 23 and 24 and first and second body sections 12 and 14 is used to attach holder 10 to a support 11. The right angled shape of holder 10 enables the user to position holder 10 against a magnetic metal horizontal corner portion of a merchandising display case or similar primary stationary support 11 such as a clothes rack or the metal edge of a counter accommodating clothes or items for sale. The elongated body of holder 10 provides holder 10 with horizontal stability and a strong-holding force to firmly retain holder 10 on support 11.

Figure 2:
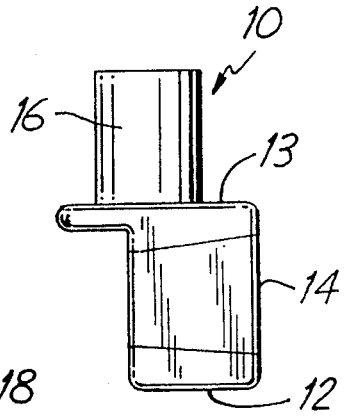
FIG. 2 is an enlarged elevational view of the sign holder.
Figure 8:
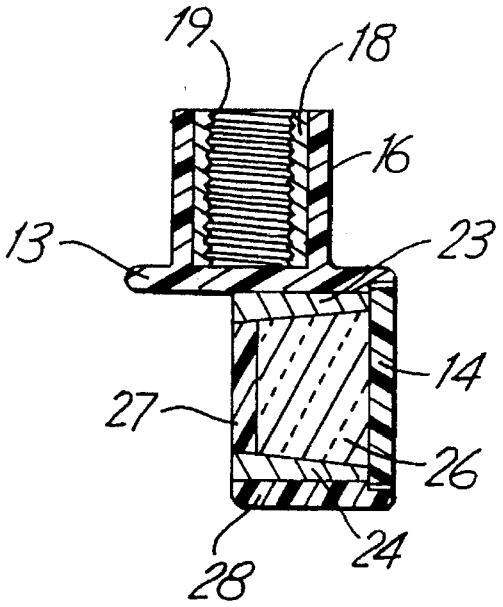
FIG. 8 is a sectional view taken along the line 8—8 of FIG. 6.

As shown in FIGS. 1, 2 and 8, top member 13 of first body section 12 is joined to side member 27 at a right angle. Top member 13 has a generally flat end portion that extends inwardly relative to side member 27 and is supported on the top of support 11. First body section 12 has partially open sides and back portions.

Figure 3:
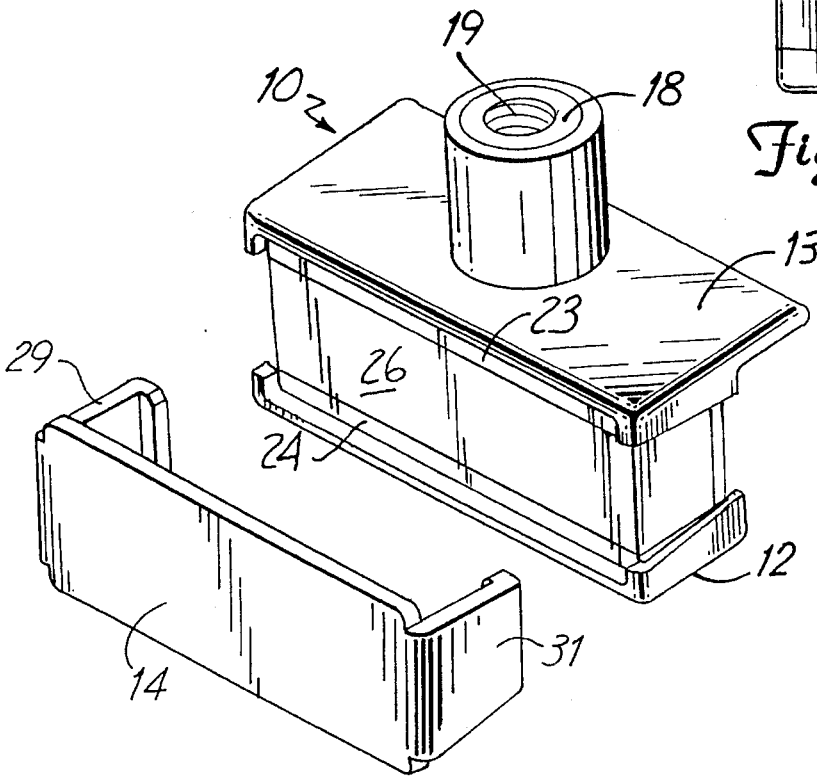
FIG. 3 is an exploded perspective view of the sign holder.

An upright cylindrical member 16 is secured to the mid-portion of top member 13 of first body section 12. As seen in FIGS. 3 and 8, cylindrical member 16 has an inner cylindrical sleeve 18 having a threaded inner surface 19 surrounding hole 17 that accommodates the threaded lower end of an upright shaft or pole 21 of sign 22. The center vertical axis of cylindrical member 16 is aligned with the vertical plane of side member 27. This enhances the balance and stability of holder 10 when accommodating sign 22. Pole 21 can be removed from cylindrical member 16 and replaced with other signs or informational material. Cylindrical member 16 can have holes with circular, rectangular or star shapes to accommodate poles having similarly shaped lower ends.

Figure 4:
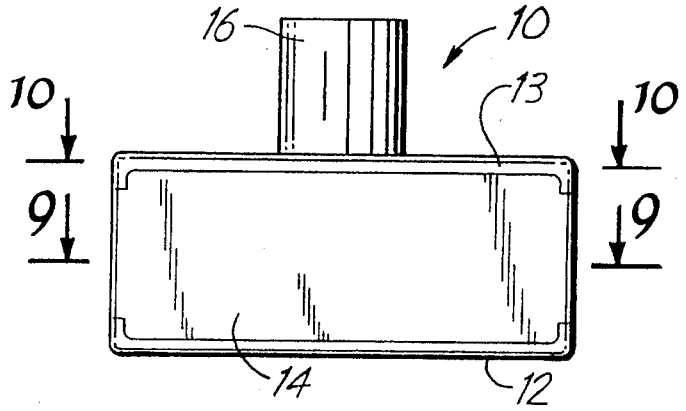
FIG. 4 is a front elevational view of the sign holder.
Figure 5:
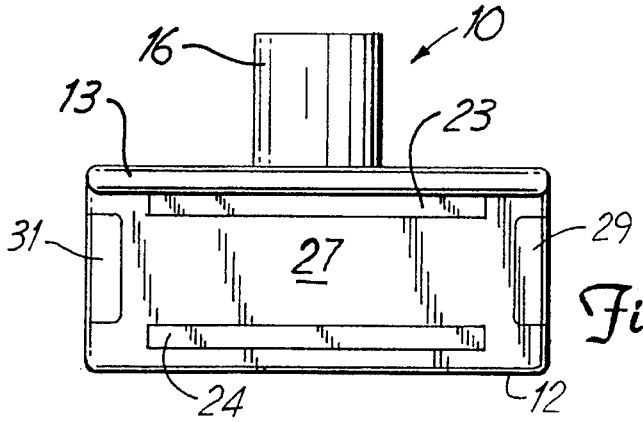
FIG. 5 is a rear elevational view of the sign holder.
Figure 6:
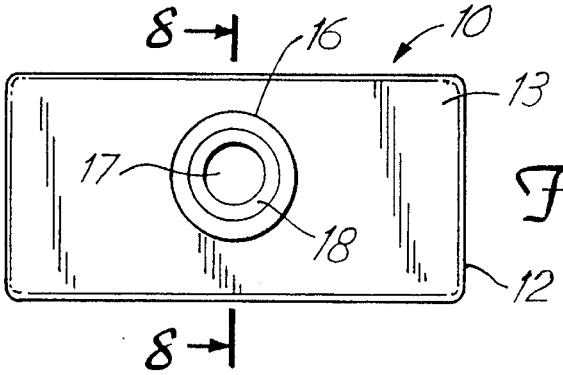
FIG. 6 is a top plan view of FIG. 4.
Figure 7:
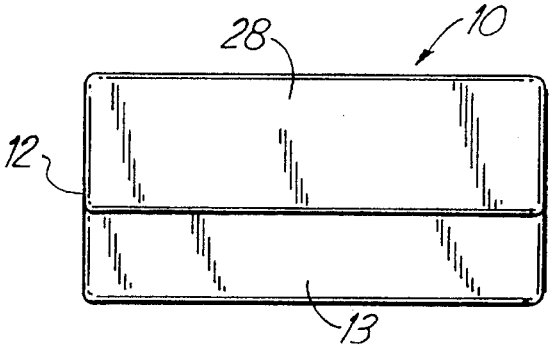
FIG. 7 is a bottom plan view of FIG. 4.
Figure 10:
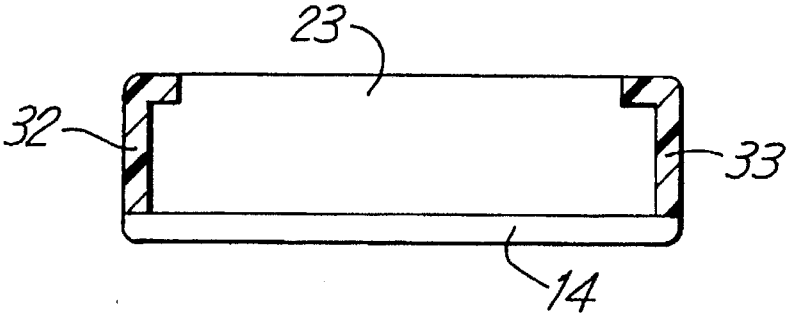
FIG. 10 is a sectional view taken along the line 10—10 of FIG. 4.

Referring to FIGS. 4 and 10, top member 13 has downwardly turned flanges 32 and 33 on opposite sides thereof. The lower edge of each flange 32 and 33 inclines at an angle that is complementary to the inclined top surfaces of arms 29 and 31 of second body section 14. The inner ends of flanges 32 and 33 are joined to the top portion of side member 27. Similarly, bottom member 28 of first body section 12 has upwardly turned flanges having upper edges that incline at angles complementary to the inclined bottom surfaces of arms 29 and 31. The inner ends of the flanges of bottom member 28 are joined to the bottom portion of side member 27, as seen in FIG. 5.

Figure 9:
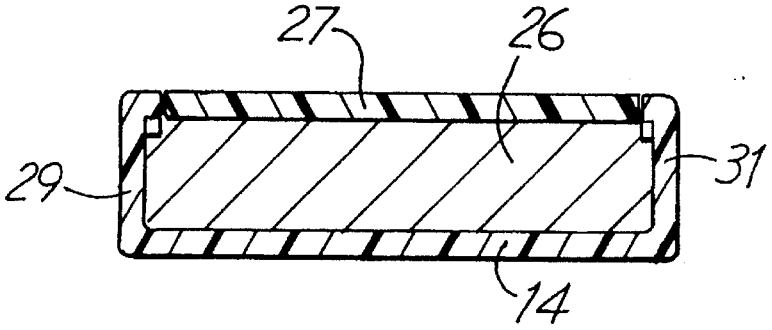
FIG. 9 is a sectional view taken along the line 9—9 of FIG. 4.

Referring to FIGS. 3 and 9, second body section 14 has a generally flat middle portion joined to inwardly directed arms 29 and 31 located adjacent the sides of magnet 26. As shown in FIG. 3, arms 29 and 31 have inclined top and bottom surfaces that converge inwardly. Arms 29 and 31 terminate in inwardly turned ends. Side member 27 of first body section 12 has vertical grooves on opposite sides thereof for accommodating the inwardly turned ends of arms 29 and 31, as seen in FIG. 5. First body section 12 has upper and lower longitudinal grooves. The middle wall portion of second body section 14 has top and bottom tongues that fit into the longitudinal grooves in first body section 12.

Referring to FIGS. 8 and 10, metal plates 23 and 24 are generally rectangular members that extend laterally through holder 10 adjacent the top and bottom of magnet 26. Plates 23 and 24 have inclined inner surfaces that converge inwardly toward side member 27 to sandwich or wedge magnet 26 therebetween. Plates 23 and 24 function as magnetic poles that magnetically attach to support 11. This polarizes and increases the holding force of magnet 26. Side member 27 of first body section 12 has laterally spaced parallel elongated top and bottom openings or slots through which the end faces of metal plates 23 and 24 project.

To construct holder 10, magnet 26 is wedged between metal plates 23 and 24 and then enclosed within first and second body sections 12 and 14 with end faces of plates 23 and 24 extending through the lateral slots in side member 27 of first body section 12. First and second body sections 12 and 14 are then secured in place with suitable means, such as welding, to thereby form an elongated right angled holder 10. The length and height dimensions of the body of holder 10 has a ratio of length to height of 2.5 to 1. This ratio of length to height of holder 10 enhances stability and holding power of holder 10. Holder 10 can have different dimensions. Body sections 12 and 14 can be made of metal or plastic. Holder 10 can have arcuate or semi-circular shapes to accommodate tubular or pipe supports.

While there has been shown and described a preferred embodiment of the sign holder of the invention, it is understood that changes in materials, sizes, and shapes of the sign holder may be made by those skilled in the art without departing from the invention. The invention is defined in the following claims.

I claim:

1. A sign holder comprising: a first body section and a second body section joined to the first body section to define an elongated generally rectangular body having a top wall and an inner side wall, upright cylindrical means mounted on the top wall and extended upwardly therefrom, the cylindrical means having a centrally located top opening for accommodating pole means carrying display sign means, magnet means enclosed within the first and second body sections and located behind the inner side wall, said side wall covering the magnet means, and magnetic pole means comprising a pair of metal plates enclosed within the first and second body sections located on opposite sides of the magnet means and extended through said inner side wall, the metal plates having linear surfaces adhering to a surface of a metal support to releasably attach the body to the support and prevent inadvertent dislocation of the body from the support.

2. The sign holder of claim 1 wherein: the body comprises a right angle member to fit corners of the support.

3. A sign holder comprising: a first body section and a second body section joined to the first section to define an elongated generally rectangular body having a top wall and an inner side wall, an upright cylindrical means joined to the top wall, the cylindrical means having a centrally located top opening for accommodating pole means carrying display sign means, and magnet means enclosed within the first and second body sections, the magnet means including magnetic pole means which adhere to a surface of a metal support to releasably attach the body to the support and prevent inadvertent dislocation of the body from the support, the magnet means being wedged between a pair of metal plates creating the magnetic pole means, the metal plates having inwardly-converging inner surfaces to wedge the magnet means therebetween.

4. The sign holder of claim 3 wherein: the body has a length to height ratio of 2.5 to 1.

5. The sign holder of claim 3 wherein: the first body section includes a pair of laterally spaced slots through which ends of the metal plates project.

6. The sign holder of claim 3 wherein: the top wall has an end portion extending inwardly relative to the side wall supported on top of the support.

7. The sign holder of claim 3 wherein: the top wall is joined to the side wall at a right angle.

8. The sign holder of claim 3 wherein: the top opening in the cylindrical means has a central vertical axis aligned with a vertical plane of the side wall.

9. The sign holder of claim 3 wherein: the pole means is removable from the top opening in the cylindrical means to allow a change of the display sign means.

10. A sign holder comprising: a first inverted L-shaped body section joined to a second U-shaped body section forming a right angle-shaped body shell, the first body section having an upper horizontal wall and a depending vertical side wall joined to a lower horizontal wall, the second body section having a generally flat middle wall portion with inwardly-directed arm means secured to the first body section to define the body shell, the side wall of the first body section has a pair of vertical grooves, the arm means having inwardly turned ends extending into the vertical grooves, the first body section having upper and lower longitudinal grooves, the middle wall portion of the second body section having upper and lower tongue members extending into the longitudinal grooves in the first body section, an upright cylindrical means joined to the upper wall, the cylindrical means having a centrally located top opening for accommodating pole means carrying display sign means, magnet means enclosed within the body shell, and magnetic pole means located adjacent the magnet means which adhere to a surface of a metal support to releasably attach the body to the support and prevent inadvertent dislocation of the body from the support.

11. A sign holder comprising: a first inverted L-shaped body section joined to a second U-shaped body section forming a right angled shaped body shell, the first body section having an upper horizontal wall and a depending vertical side wall joined to a lower horizontal wall, the second body section having a generally flat middle wall portion with inwardly directed arm means secured to the first body section to define the body shell, the upper wall joined to an upright cylindrical means, the cylindrical means having a centrally located top opening for accommodating pole means carrying display sign means, and magnet means enclosed within the body shell and located behind the side wall, said side wall covering the magnet means, magnetic pole means located adjacent opposite sides of the magnet means, said side wall having slots accommodating portions of the pole means which adhere to a surface of a metal support to releasably attach the body to the support and prevent inadvertent dislocation of the body from the support.

12. The sign holder of claim 11 wherein: the magnet means is wedged between a pair of metal plates creating the magnetic pole means.

13. A sign holder comprising: a first inverted L-shaped body section joined to a second U-shaped body section forming a right angle-shaped body shell, the first body section having an upper horizontal wall and a depending vertical side wall joined to a lower horizontal wall, the second body section having a generally flat middle wall portion with inwardly-directed arm means secured to the first body section to define the body shell, an upright cylindrical means joined to the upper wall, the cylindrical means having a centrally located top opening for accommodating pole means carrying display sign means, and magnet means enclosed within the body shell, the magnet means including magnetic pole means which adhere to a surface of a metal support to releasably attach the body to the support and prevent inadvertent dislocation of the body from the support, a pair of metal plates creating the magnetic pole means located adjacent the opposite sides of the magnet means, the metal plates have inwardly converging inner surfaces to wedge the magnet means therebetween.

14. The sign holder of claim 13 wherein: the side wall of the first body section includes laterally spaced top and bottom slots through which ends of the metal plates project.

15. The sign holder of claim 13 wherein: the upper wall has an end portion extending inwardly relative to the side wall supported on top of the support.

16. The sign holder of claim 13 wherein: the upper and lower walls of the first body section are joined to the side wall at right angles.

17. The sign holder of claim 13 wherein: the top opening in the cylindrical means has a central vertical axis aligned with a vertical plane of the side wall.

18. The sign holder of claim 13 wherein: the pole means is removable from the top opening in the cylindrical means to allow a change of the display sign means.

19. The sign holder of claim 13 wherein: the body shell has a length to height ratio of 2.5 to 1.

20. A sign holder comprising: a first inverted L-shaped body section joined to a second U-shaped body section forming a right angle-shaped body shell, the first body section having an upper horizontal wall and a depending vertical side wall joined to a lower horizontal wall, the second body section having a generally flat middle wall portion with inwardly-directed arm means secured to the first body section to define the body shell, the upper and lower walls of the first body section have flange means located adjacent the arm means of the second body section, the flange means and arm means each having a complementary inclined surface, an upright cylindrical means joined to the upper wall, the cylindrical means having a centrally located top opening for accommodating pole means carrying display sign means, magnet means enclosed within the body shell, and magnetic pole means located adjacent the magnet means which adhere to a surface of a metal support to releasably attach the body to the support and prevent inadvertent dislocation of the body from the support.

21. A holder mountable on a support for accommodating a shaft of a sign comprising: a right angle body member having an upright cylindrical member for accommodating the shaft of a sign, the body member having a first body section and a second body section joined to the first body section, and magnet means enclosed within the first and second body sections, the magnet means being wedged between a pair of plates, the plates having inwardly converging inner surfaces to wedge the magnet means therebetween, the first body section including laterally spaced top and bottom slots through which ends of the plates project whereby the ends of the plates magnetically adhere to a metal surface of the support to releasably attach the body member to the support.

22. The holder of claim 21 wherein: the first body section has an inwardly extending upper wall portion supported on top of the support.

23. The holder of claim 21 wherein: the cylindrical member has a centrally located top opening for accommodating the shaft.

24. The holder of claim 23 wherein: the top opening has a central vertical axis aligned with a vertical plane of the first body section.

25. The holder of claim 23 wherein: the shaft is removable from the top opening in the cylindrical means to allow a change of the display sign means.

26. The holder of claim 22 wherein: the first body section has a generally vertical side wall portion joined to the upper wall portion at a right angle.

* * * * *